United States Patent [19]

Sommerfield

[11] Patent Number: 4,878,333

[45] Date of Patent: Nov. 7, 1989

[54] FILLER LINE MONITORING SYSTEM WITH AUTOSYNCHRONIZATION

[75] Inventor: John R. Sommerfield, Los Gatos, Calif.

[73] Assignee: Peco Controls Corporation, Milpitas, Calif.

[21] Appl. No.: 146,170

[22] Filed: Jan. 20, 1988

[51] Int. Cl.[4] ..... B65B 57/00

[52] U.S. Cl. ..... 53/53; 53/67; 53/77; 53/282; 53/500; 141/83; 141/95

[58] Field of Search ..... 53/67, 64, 77, 52, 53, 53/500, 54, 272, 282, 266 R; 141/83, 144, 140, 96, 95, 94; 250/357.1; 364/469, 468, 478, 479; 378/57, 52; 340/825.14, 825.16

[56] References Cited

U.S. PATENT DOCUMENTS

| | | | |
|---|---|---|---|
| 3,368,593 | 2/1968 | Mamas | 141/83 |
| 4,038,805 | 8/1977 | Holladay et al. | 53/53 |
| 4,337,608 | 7/1982 | Schlosser et al. | 53/282 X |
| 4,390,782 | 6/1983 | Vornfett | 250/223 B |
| 4,408,295 | 10/1983 | Kavage et al. | 364/478 X |
| 4,514,954 | 5/1985 | Anderson et al. | 53/282 X |
| 4,691,496 | 9/1987 | Anderson et al. | 53/53 |

OTHER PUBLICATIONS

"The New Generation of Filler Line Monitoring" published by Heuft GmbH of West Germany.

"Fill Level Detectors, Bottle Sorters, Crate Checkers and Data Control Systems" published by Heuft GmbH of West Germany.

Product Brochure entitled "Scanex Model 1280, Fill Monitor System", Apr. 17, 1973.

"Gamma 101 P Valv-Chek/Sampling System (GAM1 PVC/S)" Technical Manual, Peco Controls Corporation, Milpitas, Calif., 1984.

*Primary Examiner*—James F. Coan

*Attorney, Agent, or Firm*—Skjerven, Morrill, MacPherson, Franklin & Friel

[57] ABSTRACT

A monitoring and control system is provided for a container filling line having an in-feed conveyor for conveying empty containers, a multiple-valve rotary fill station supplied by the in-feed conveyor for filling the containers, a multi-head closer station for closing the then-filled containers, a discharge station for discharging the filled and closed containers to a take-away conveyor, the take-away conveyor not being synchronized with the in-feed conveyor, the operation of the filler station and the operation of the closer station, the monitoring and control system including means at the discharge station for generating a first signal responsive to each container passing the discharge station, a detection station provided at a location on the take-away conveyor spaced from the discharge station for detecting one or more characteristics of a container passing thereby, means at the detection station for generating a second signal responsive to each container passing the detection station, means for generating a first measure of the number of containers on the take-away conveyor between the discharge station and the detection station on the basis of the first signal and the second signal, means for generating a second measure, independently of the means for generating the first measure, of the number of containers between the discharge station and the detection station, means for comparing the first measure with the second measure and means for changing the first measure to substantially agree with the second measure if the comparison indicates that the first and the second measures do not substantially agree.

14 Claims, 2 Drawing Sheets

FILLER LINE MONITORING SYSTEM WITH AUTOSYNCHRONIZATION

CROSS REFERENCE TO RELATED APPLICATIONS

A microfiche appendix, Appendix A, consisting of four microfiche and 297 frames is included herewith illustrating a computer program for implementing the present invention.

BACKGROUND OF THE INVENTION

1. Field of the Invention

This invention relates to high speed filler lines which are designed to fill cans and bottles and to detect automatically malfunctions in the filling and/or sealing of cans and bottles and to minimize the effects of such malfunctions. Soft drink and beer cans or bottles are typical products which are conveyed into and filled in a carousel-type filler station, are moved into a sealer station where can lids or bottle tops are applied from where the completed containers with or without labeling are off-conveyed. The filler station typically comprises a series of container-carrying pockets which are positioned with respect to a series of filler valves where simultaneous filling of the containers takes place. In one form of filler station, manufactured by Crown Cork & Seal, or H & K Co., seventy-two valves are employed with closing, (e.g., can or bottle top application) taking place downstream at seven positions within the closer.

2. Prior Art

A system representative of the prior art is the GAMMA 101 System manufactured by F. Justus & Co., Hamburg, W. Germany. It provides a fill height detector for cases or bottles utilizing gamma rays in conjunction with means for sensing missing containers and, if installed behind the filler, can also indicate or identify the number of a faulty filler device.

U.S. Pat. No. 4,691,496, Filler Line Monitoring System, assigned to the same assignee as the present application, describes a filler/closer line monitoring system in which the identify of a faulty filler valve or closer can be determined and, if desired, the faulty device can be disabled until it can be repaired. This patent is incorporated herein by reference.

U.S. Pat. No. 3,818,232, Container Fill Level Inspector With Product Averaging System, discloses a container fill height measuring system in which the measured fill condition of individual containers is averaged over a number of containers and/or filler heads.

A product brochure entitled "Scanex Model 1280, Fill Monitor Line" published Apr. 21, 1973 by Nuclearay, Inc., assignee of the above identified U.S. Pat. No. 3,818,232, contains additional information relative to the fill monitor system with the averaging feature.

The following publications describe a filler/closer monitoring system in which the identity of a faulty filler valve or closer can be determined and if desired, the entire line can be shut down.

"The New Generation of Filler Line Monitoring", Published by Heuft GmbH.

"Fill Level Detectors Bottle Sorters Crate Checkers Data Control Systems", Published by Heuft GmbH, 1980.

SUMMARY OF THE INVENTION

The system of the present invention is intended to make accurate measurements of fill height from individual valves in a filler. Since the measurement device may be located downstream of the filler and closer, it is essential to be able to track containers from the closer to the inspection device. A second essential feature of the present invention is the capability to take samples from individual valves or closer positions. Again, these sam ples are taken downstream of the closer by means of a ejector. The ejector may or may not be located at th same position as the inspection device.

The system is equipped with sensors such that whe a container leaves the closer, as sensed by the objec sensor, it is precisely known as to which filler valve an closer position filled and closed the container. A critic requirement in any filler/closer system is to track th container after the container passes the object sensor. is now on a takeaway conveyor and subject to bunchin and slip and yet must be tracked to both the inspectio and sampling stations. This tracking must be accon plished without error.

In prior art systems, basic valve synchronization accomplished by means of a first-in-first-out (FIFC memory in the computer associated with the systen Since the filling and closing valve numbers are know at the object sensor, as each container passes the objec sensor its valve number is placed into the FIFO. A each container is sensed at the inspection or ejectio station, the valve number is extracted from the FIF memory. Under perfect conditions this will alwa produce the proper valve number. The number c entries in the FIFO memory will be equal to the numbe of containers, at any instant, on the conveyor betwee the object sensor and the inspection device or betwee the object sensor and the ejector, depending on the typ of operation. Each time a gap occurs, either forced c natural, the computer will clear its FIFO memory t zero; that is, it will remove all entries from the FIF memory. This is an automatic resynchronization featur which forces the number of entries in the FIFO to b correct again.

However, total reliance on the FIFO concept t provide valve synchronization has a serious flaw. I practice, containers are sometimes lost between th object sensor and the inspection device or ejector. Th may be for a number of reasons, such as a containe falling down and not being sensed. Or, an empty cor tainer may be blown off the conveyor, or containe may be manually removed or restored based on oper tor action, or the second sensor may malfunction. If an of these events occur, valve synchronization is lost, an the container reaching the inspection station or th ejector will be taken as originating from the wron position. This condition will exist until a compensatin event or a gap occurs.

For example, a count called the gamma FIFO is count of how many containers the system believes ar between the object sensor and the gamma sensor. A sume that the gamma sensor malfunctions. The gamm FIFO count will then change because the system dc esn't receive the correct count of the number of cor tainers passing the gamma sensor. That is, with th gamma sensor malfunctioning and the object sensc continuing to detect and count containers passing th object sensing station, the gamma FIFO count wi build up above the correct value since this count is nc being decremented by pulses from the gamma sensor The system of the present invention is similarly cap ble of detecting and compensating for errors where th gamma FIFO count is less than the proper value. Suc a situation could occur, for example, in the case of malfunctioning object sensor which would cause th gamma sensor to decrement the gamma FIFO cou since no pulses are being received from the object se sor.

In the absence of the automatic synchronization ("autosync") feature of the present invention, this incorrect value of the gamma FIFO count will remain and provide a misleading indication of the number of containers passing between the object sensor and the gamma sensor.

The present invention provides a technique to automatically maintain synchronization without requiring the presence of a gap. The autosync feature of the present invention retains the basic features of the FIFO memory concept discussed above and, in addition, overlays an independent method of determining the number of containers between the object sensor and the inspection station or between the object sensor and the ejector station. The autosync feature functions by estimating the average travel time of a container from the object sensor to the inspection or ejection station. Even though single containers may have different travel times, the average travel time of a number of containers may be assumed to be constant.

In order to eliminate the effects of speed variation, the travel time is taken as the number of pulses produced by a speed encoder that is physically coupled to the takeaway conveyor such that the number of pulses produced per unit distance traveled is a constant. Therefore, each container leaving the object sensor will require a specific number of encoder pulses, on the average, to reach the inspection station or the ejector. The computer in the present system, given the encoder information, is able to time containers through the system.

The key to the present invention is the establishment of an independent method of determining how many containers are in a given section of conveyor line, and in particular a method of determining that that number is not subject to cumulative errors. It is these cumulative errors which cause problems, and the present invention is always self-correcting to prevent cumulative errors.

The FIFO count and encoder counts should be the same in normal operation; that is, the estimate of the number of containers between the object sensor and the inspection station based on FIFO count entries should be exactly the same as the number of containers derived from the encoder counts. The encoder constant is subject to short term variations based on container slippage, passage through twists or other devices that have an impact on actual container trajectories, etc. and therefore an averaging process is utilized to smooth the data prior to making any corrections.

A running average of FIFO count and encoder count are continuously compared. If the average difference becomes effectively greater than one half container, the FIFO count is adjusted accordingly; that is, an artificial entry is made to the FIFO memory or an entry is deleted from the memory to force the count to be correct. These corrections are performed automatically upon occurrence of lost or added containers.

While this correction is being carried out, the measurement process at the gamma tester is inhibited so that during out-of-sync conditions gamma measurements are not taken. Similarly, sampling is not performed during the interval when a correction process is taking place. If a sample had been started prior to the auto-synchronization process, that sample would be aborted.

DESCRIPTION OF THE PREFERRED EMBODIMENT

Figure 1:
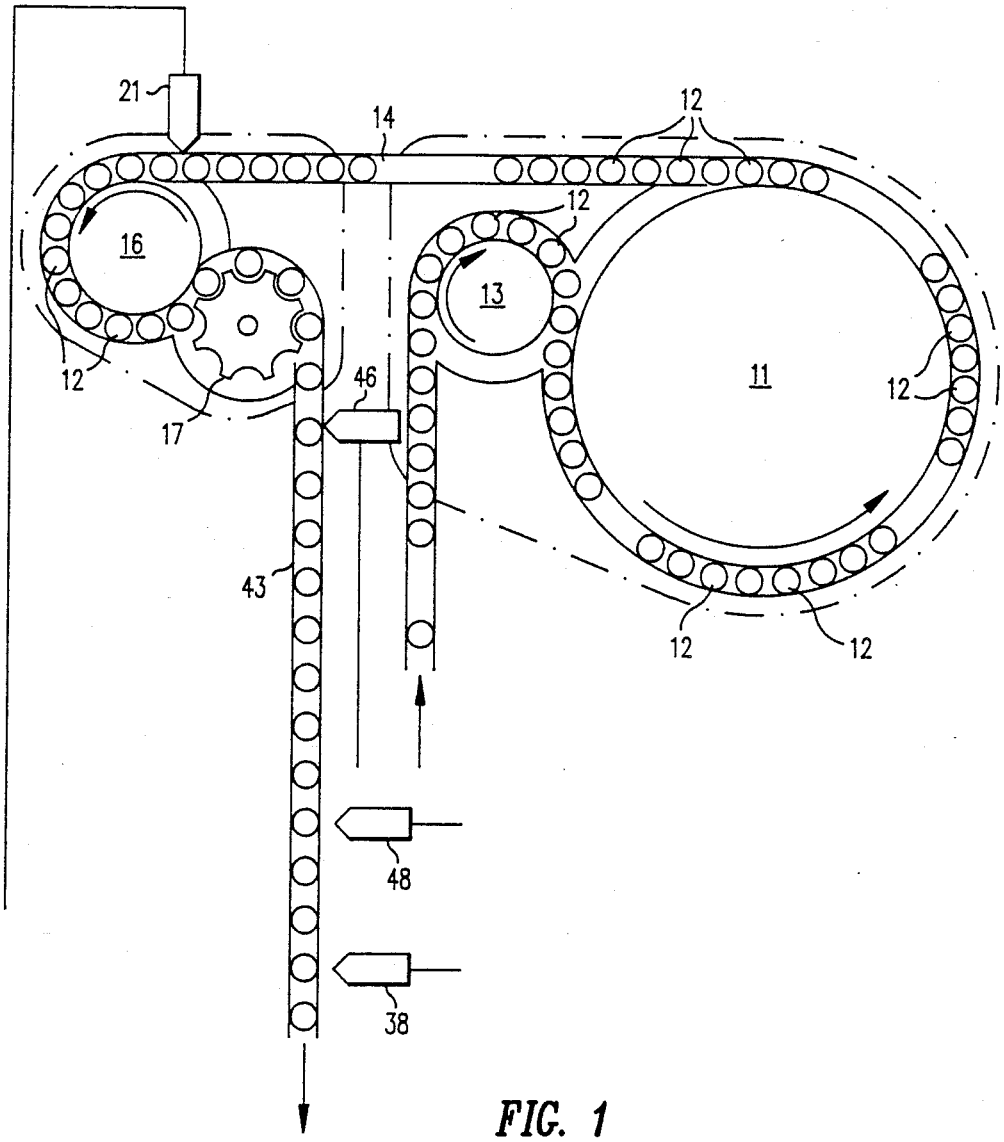
FIG. 1 is a schematic view of portions of a typical filler/closer line showing the locations of the sensors employed in the present invention.

The following description refers to a container filling and sealing process line, but it will be understood that the invention is equally applicable to other container processing equipment and the detection of malfunctions therein. Referring to FIG. 1, reference numeral 11 designates a typical container filler/closer system on which a plurality of empty containers 12 are carried for filling. As is well known in the art, and as set out in greater detail in the above-incorporated U.S. Pat. No. 4,691,496, a complete filler/closer system includes a number of additional elements such as a microprocessor, control logic, calibration and diagnostic logic. The empty containers to be filled in filler 11 are supplied by a rotary supply mechanism 13 and deposited on the rotating portion of filler 11. As is well known in the art, filler 11 may contain a number of filler pockets, each of which contains a separate filling valve for filling the container 12 located at that pocket.

After filling, the containers from filler 11 are driven on a track 14 to a closing unit 16 where the containers are closed, such as by seaming for metal containers or by capping for bottle-type containers. After sealing in unit 16, containers 12 are removed from the seamer by suitable means, such as a well known starwheel mechanism 17 which removes containers 12 and deposits them on a track or takeaway conveyor 43 for further processing. Such further processing may include inspection for container fill height, proper label application, proper cap closure in the case of bottles, and the like.

The system of the present invention employs an index sensor 21 associated with unit 16 which generates a signal or pulse for each revolution of unit 16. This serves as a reference point to identify the origin of the container as it passes through the unit. Such an index sensor may be of the type shown in FIG. 2 of the above identified U.S. Pat. No. 4,691,496 and described therein. The system also includes a first object sensor 46 disposed at or near the exit of unit 16 which generates a signal or pulse for each container exiting unit 16 and starwheel 17 and passing sensor 46. The system also includes a second sensor 48 which may be located at the filling inspection station where the fill level of each passing container is monitored, such as by the GAMMA 101 System identified above. The system may also include an additional sensor 38 which may be located, for example, at the sample sensing location in a sampling path, as described in more detail in the above identified U.S. Pat. No. 4,691,496. In the following description and claims, the expression "second sensor" may apply to either sensor 48 or sensor 38, or both. As is well known in the art, the system may include other sensors, such as some or all of the types of sensors shown in the above-identified U.S. Pat. No. 4,691,496.

Figure 2:
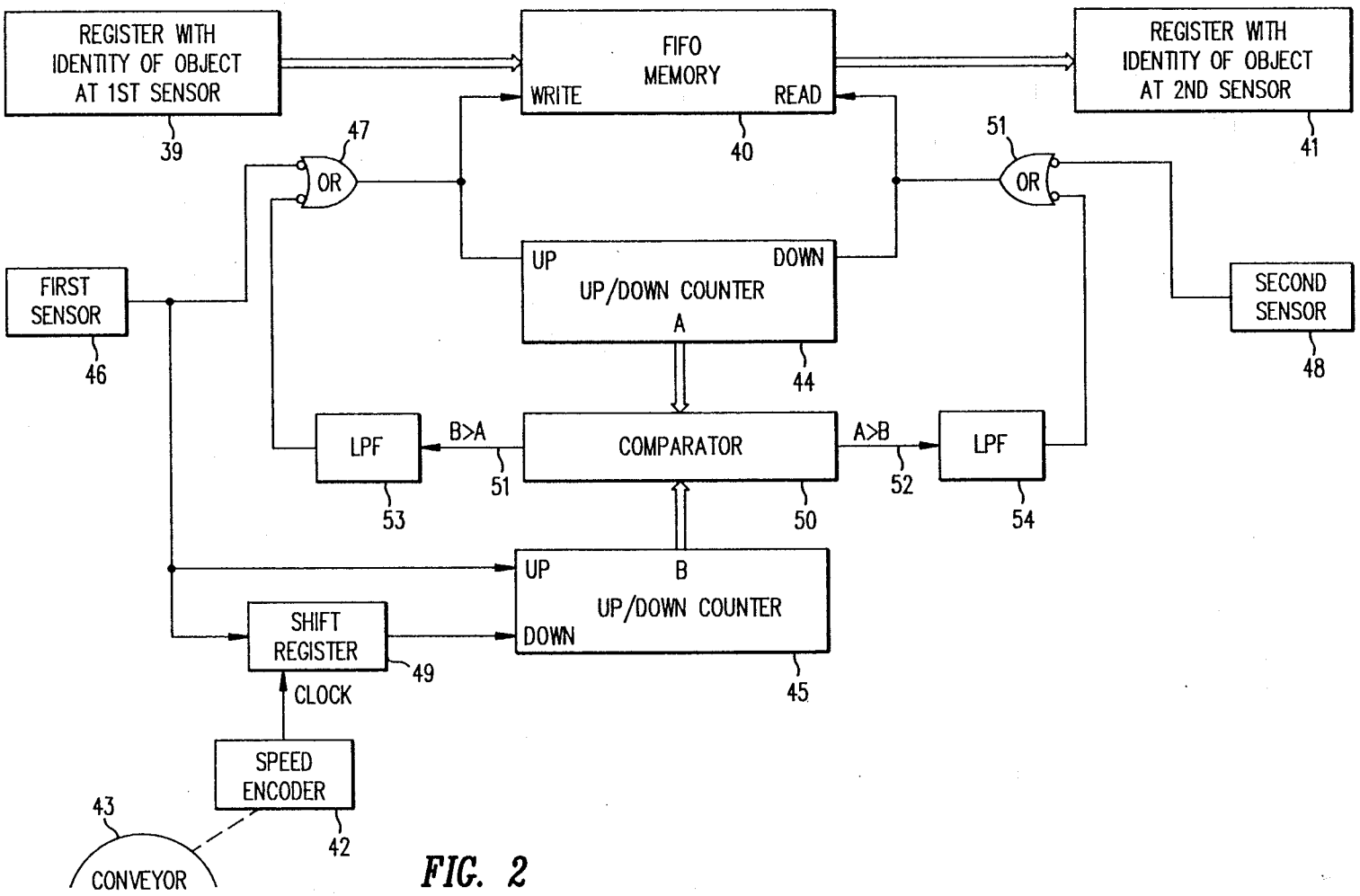
FIG. 2 is a block diagram showing the circuit and logic elements employed in the invention.

The block diagram of FIG. 2 illustrates the implementation of the autosync features of the present invention and it is shown in logic element form. The first sensor 46 is the sensor located at the beginning of the conveyor where objects are discharged from the filler/- closer line to the takeaway conveyor 18. Conveyor 18 is not synchronized with the filler/closer lines 11 and 16 and they are driven by different motors. The second sensor 48 is located somewhere along conveyor 18 following the first sensor, such as at the fill height detector station. Alternatively, the second sensor could be sensor 38 located at the sampling station as described above.

The first sensor 46 produces a signal for each passing container sensed. This sensing supplies a pulse through an OR gate 47 to a FIFO memory 40 to cause FIFO 40 to receive from a register 39 an indication of the identity of the sensed container. This identification could be a filler valve position number, a closer head position number or any other identification, as is well known in the art.

The first sensor 46 also applies a pulse through OR gate 47 to a first up/down counter 44 which contains essentially a count of the number of containers that are in the FIFO memory. The first sensor also directly produces an "up" pulse to a second up/down counter 45 which is part of the independent method of the present invention for determining how many containers are in the section of conveyor line between the first sensor and the second sensor, as will be described in more detail below.

The second sensor 48 produces a pulse through an OR gate 51 which is applied to the FIFO memory 40 to cause a read action to occur which withdraws the identity of the container at the second sensor from FIFO 40 and reads it into a register 41. Additionally, second sensor 48 produces a pulse through an OR gate 55 which causes up/down counter 44 to count down one count, correcting counter 44 in correspondence with the sensor activity. Up/down counter 44 maintains a count then of the number of elements in the FIFO memory based on operation of the first sensor and second sensor. If no errors occur or if no abnormal conditions occur, then this count will be an accurate representation of the number of elements between the first and second sensors. However, if an object is removed subsequent to passing the first sensor but prior to reaching the second sensor, or if the second sensor malfunctions, then the FIFO memory will not contain the correct identity of the objects in future operation and tracking is faulty.

The present invention employs a second, independent technique for measuring the transit of a container from a first position to a second position. Since a container is traveling on a conveyor 43, one method of determining the movement of the container along the conveyor is to have a speed encoder attached to the conveyer which produces electrical pulses that are proportional to conveyor speed and hence proportional to the physical displacement of a container along the conveyor. Such a speed encoder is represented at 42 in FIG. 2 and is physically connected to conveyor 43.

The second up/down counter 45 also is incremented for each object passing the first sensor 46. Counter 45 is decremented one count at the anticipated time that the container reaches the second sensor, not by being sensed by the second sensor, but by means of a propagation delay implemented by means of a shift register 49. Up/down counter 45 is incremented for every container sensed at the first sensor and is decremented one count at an anticipated time when that container has reached the position of the second sensor as measured by the length of shift register 49. That is, the length or the number of elements in shift register 49 is chosen to be such that the difference between the pulse on its input and the pulse on its output is equivalent to the number of encoder pulses from encoder 42 during the period it takes a container to travel along the conveyor from the first sensor position 46 to the second sensor position 48.

Counter 45 thus provides an independent means of determining how many containers are present on the conveyor between the first sensor and the second sensor. Furthermore, it has one very important property. Any transient errors introduced in the system by a sensor not seeing a container or by a container being removed between the two sensors or by a container being added between the two sensors, which as previously described, cause the FIFO memory contents to be erroneous, have only a temporary effect on up/down counter 45. That is, any errors introduced are non-cumulative errors, whereas in the case of the FIFO memory, the errors are cumulative, and would then exist until some other event occured to correct them.

The system of the present invention thus has two measures of how many containers are between the two sensors. Up/down counter 44, which is a direct count based on the sensor actions, and up/down counter 45, which is a count based on the number of containers passing the first sensor and the encoder constant determining the length of shift register 49. The contents of these two counters are used to determine whether a malfunction has occured or whether a container has been lost or added between the two sensors.

This is accomplished in the following manner. The contents of the two counters are compared in a comparator 50. If the system is normal and functioning properly, comparator 50 should indicate a zero difference between the contents of the two counters. Because of variations in the timing of the sensors and the speed encoder, it is possible that the comparator will, even in normal operation, be plus or minus one or two counts in the normal course of events, as would be expected to accommodate timing variations and other possible differences in a system of this type. Therefore, the outputs of comparator 50 are filtered through low-pass filters 53, 54 to remove short-term variations.

There are two outputs of the comparator. One output on line 51 is an output indicating that up/down counter 45 has a greater count than up/down counter 44. The second output on line 52 is such that if the count in up/down counter 44 is greater than the count in up/down counter 45, the output on line 52 will be activated. This means that the output on line 51 will be active if a can has been lost between first sensor 46 and second sensor 48, or if second sensor 48 does not properly sense a container. Either of these conditions will cause a pulse to be present at line 51. In a similar fashion, line 52 will have an output pulse if a container has been added between first sensor 46 and second sensor 48.

Low-pass filters 53 and 54 are applied to these two outputs so that any short-term variations in timing or similar effects will not cause a corrective action immediately, but if the differences persist longer than the time constant of the low-pass filters, then an appropriate control action will take place.

The appropriate control action is to correct the number of entries in FIFO memory 40 and also to correct the count in counter 44, which is the FIFO memory count, to make it consistent with the count in counter 45, which as discussed previously, is not subject to cumulative error. This control action is performed by applying the output of low-pass filter 53 to OR gate 47 whenever the comparator indicates that the FIFO memory contents are short one or more entries. By this means, a fictitious write is applied to the FIFO memory, which then writes a dummy identity having no meaning into the FIFO memory, and at the same time increments counter 44 so that counter 44 continues to represent the number of entries in the FIFO memory.

Similarly, any output from low-pass filter 54 is supplied through OR gate 55 to decrement the count in counter 44, and at the same time to extract an element or an identity from the FIFO memory. When this action occurs, there is a temporary disturbance in the FIFO memory, but following a short period of time, this disturbance will propagate out. The significant thing is that the correct number of entries are forced into the FIFO memory and counter 44 is forced to represent the true number of containers between the first sensor and the second sensor.

One of the key elements of the invention is to determine the length of shift register 49 so that the estimation of when a container arrives at the second sensor based on the number of clock pulses produced by the speed encoder is correct. The length of the shift register is called the encoder constant and is determined as part of setup of the system, and entered into the system so that operation is correct. This encoder constant is a constant only if the containers do not slide or otherwise shift on the conveyor during their transit from the first sensor to the second sensor.

It has been found in practice that this is not strictly a constant, but can be a function of the velocity that the container has as it passes the first sensor. For example, if whatever mechanism is feeding the containers into the feed conveyor line speeds up or slows down, the momentum of the containers as they pass the first sensor may change, and this may cause more or less slippage on the conveyor. If this occurs, then the encoder constant will not be exactly correct. This can be averaged out by choosing an encoder constant which represents the average transit time of the containers, or the encoder constant may be modified depending upon the velocity of the containers as they enter the tracking system. In other words, one of the important features of the present invention is the ability to adjust the encoder constant dynamically depending upon the conditions that exist at any particular time.

FIG. 2 illustrates the key elements of the invention in a hardware embodiment. In a software embodiment of the invention some operations may be performed differently. An example of that is a decision as to where to locate the low-pass filters. In FIG. 2 they are located on the outputs of comparator 50. However, they could just as well be located on the outputs of the individual counters 44, 45 before the counts therefrom are applied to the inputs of comparator 50.

I claim:

Appendix A, a microfiche appendix hereto, lists the source code statements for carrying out the present invention including the auto-sync feature thereof. This code illustrates an implementation of the present invention utilizing a 8080/8085 microprocessor. Appendix A includes the following modules of code:

1. Diagnostic Module for Sensor Calibration G101P Valve Check System
2. G101P Valve Check System—Encoder Modules
3. G101P Valve Check/Sampling System Initialization Modules
4. 101P Valve Check System Interrupt Service Routines
5. Keyboard Monitor System for QVC
6. Quantitative Valve Check System Main Program Module
7. G101P Valve Check/Sampling System Print Module
8. G101P Valve Check/Sampling Main Program
9. Quantitative Valve Check System Standard Subroutines (3/24/86)
10. Quantitative Valve Check System Support Subroutines (9/4/87)—

1. A monitoring and control system for a container filling line having an in-feed conveyor for conveying empty containers, a multiple-valve rotary fill station supplied by said in-feed conveyor for filling said containers, a multi-head closer station for closing the then-filled containers, a discharge station for discharging the filled and closed containers to a take-away conveyor, said take-away conveyor not being synchronized with said in-feed conveyor, the operation of said filler station and the operation of said closer station, said monitoring and control system comprising:

means at said discharge station for generating a first signal responsive to each container passing said discharge station;

a detection station provided at a location on said take-away conveyor spaced from said discharge station for detecting one or more characteristics of a container passing thereby;

means at said detection station for generating a second signal responsive to each container passing said detection station;

means for generating a first measure of the number of containers on said take-away conveyor between said discharge station and said detection station on the basis of said first signal and said second signal;

means for generating a second measure, independently of said means for generating said first measure, of the number of containers between said discharge station and said detection station;

means for comparing said first measure with said second measure; and means for changing said first measure to substantially agree with said second measure if said comparison indicates said first and said second measures do not substantially agree.

2. A monitoring and control system in accordance with claim 1 including first-in-first-out memory means;

means for supplying to the input of said first-in-first-out memory an indication of the identity of the filler valve or the closer head which performed the operation on the container passing said discharge station;

means for advancing said filler head or said closer head identity indications through said first-in-first-out memory means in response to each said first signal representing a container detected passing said discharge station; and means for storing the output of said first-in-first-out memory as an indication of the identity of the filler head or closer head which performed the operation on the container passing said detection station.

3. A monitoring and control system in accordance with claim 1 including a first up/down counter;

means for supplying an "up" pulse to said first counter for each container detected passing said discharge station; and means for supplying a "down" pulse to said first counter for each container detected passing said detection counter;

whereby said first counter contains said first measure of the number of containers on said take-away conveyor between said discharge sitation and said detection station.

4. A monitoring and control system in accordance with claim 1 in which said second measure of the number of containers between said discharge station and said detection station is generated on the basis of the speed of said take-away conveyor.

5. A monitoring and control system in accordance with claim 4 in which said second measure is generated by means including a speed encoder coupled to said take-away conveyor, said speed encoder generating encoder pulses during movement of said conveyor.

6. A monitoring and control system in accordance with claim 5 including shift register means having an input connected to said speed encoder and having a storage length equal to the number of said encoder pulses generated during travel of a given container between said discharge station and said detection station.

7. A monitoring and control system in accordance with claim 6 including a second up-down counter;

means for supplying output pulses from said shift register to the "down" input of the said up-down counter; and means for supplying said first signals from said means for detecting the number of containers passing said discharge station to the "up" input of said second counter, to provide in said second counter said second measure of the number of containers between said discharge station and said detection station.

8. A monitoring and control system in accordance with claim 7 including a comparator;

means for supplying the counter outputs from said first and said second counters to said comparator for comparison therein, to provide an indication in said comparator of any difference in the contents of said first counter and said second counter.

9. A monitoring and control system in accordance with claim 8 including means for supplying to said first-in-first-out memory pulses to advance the contents of said first-in-first-out memory if said comparator indicates that the count in said second counter is greater than the count in said first counter.

10. A monitoring and control system in accordance with claim 9 including means for supplying signals to said first-in-first-out memory to remove therefrom identity indications of said containers stored in said first-in-first-out memory if said comparator indicates that the count in said first counter is greater than the count in said second counter.

11. A monitoring and control system in accordance with claim 10 including means for averaging the outputs of said comparator over a period of time.

12. A monitoring and control system in accordance with claim 11 in which said averaging means includes low pass filters connected to the outputs of said comparator.

13. A monitoring and control system in accordance with claim 6 including means for dynamically varying the storage length of said shift register means to vary the number of encoder pulses stored therein.

14. A monitoring and control system for a container filling line having an in-feed conveyor for conveying empty containers, a multiple-valve rotary fill station for filling said containers; a multi-head closer station to close the then-filled containers, a discharge station for discharging the filled containers to a take-away conveyor, said take-away conveyor not being synchronized with said in-feed conveyor and the operation of said closer station; a detection station positioned at a location on said take-off conveyor spaced from said discharge station for detecting one or more characteristics of a container passing thereby; said monitoring and said control system comprising:

(a) a first container sensor located at or upstream of said discharge station for producing a first signal for each container passing said first container sensor;

(b) a second container sensor located at or near said detection station for producing a second signal for each container passing said detection station;

(c) first means for storing an indication of the identity of each container passing said first container sensor;

(d) means for storing said first identity indication in a first-in-first-out memory means;

means for sequentially advancing said first identity indications through said memory means as said first identity indications are generated, said memory means having a storage length equal to the number of container positions on said take-away conveyor between said first container sensor and said second container sensor;

whereby the number of identity indications in said memory means when said memory means is full provides a first measure of the number of containers on said take-away conveyor between said first sensor and said second sensor;

(e) second means for storing the indication of the container identity as said identity indication exits from said memory means;

(f) means for generating a second measure of the number of containers on said take-away conveyor between said first sensor and said second sensor;

(g) means for comparing said first measure of said containers with said second measure of said containers; and (h) means for correcting said first measure to substantially agree with said second measure if said first and said second measures are not substantially identical.

* * * * *